US006749477B2

(12) United States Patent
Min et al.

(10) Patent No.: US 6,749,477 B2
(45) Date of Patent: Jun. 15, 2004

(54) METHOD OF FORMING SPACER IN FLAT PANEL DISPLAY

(75) Inventors: Kyung-won Min, Kyungki-do (KR); Seung-nam Cha, Kyungki-do (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 111 days.

(21) Appl. No.: 10/166,270

(22) Filed: Jun. 11, 2002

(65) Prior Publication Data

US 2002/0187709 A1 Dec. 12, 2002

(30) Foreign Application Priority Data

Jun. 12, 2001 (KR) ..... 2001-32950

(51) Int. Cl.[7] ..... H01J 9/00; H01J 9/24

(52) U.S. Cl. ..... 445/24; 445/24; 445/25; 156/1; 156/60; 156/275.3; 156/275.5; 156/275.7; 428/343; 428/345; 427/207.1

(58) Field of Search ..... 445/24, 25; 156/1, 156/60, 370.1, 275.1, 275.3, 275.5, 275.7, 272.2, 273.5; 428/343, 345; 313/292; 427/207.1; 349/187

(56) References Cited

U.S. PATENT DOCUMENTS

| | | | | | |
|---|---|---|---|---|---|
| 4,924,243 | A | * | 5/1990 | Sato et al. | 349/187 |
| 5,385,499 | A | | 1/1995 | Ogawa et al. | |
| 5,486,126 | A | | 1/1996 | Cathey et al. | |
| 5,545,280 | A | * | 8/1996 | Wenz | 427/207.1 |
| 5,558,732 | A | | 9/1996 | Hamon | |
| 5,788,550 | A | | 8/1998 | Jones et al. | |
| 5,919,606 | A | | 7/1999 | Kazlas et al. | |
| 6,031,593 | A | * | 2/2000 | Morikawa et al. | 349/187 |
| 6,312,546 | B1 | * | 11/2001 | Bannister et al. | 156/230 |

FOREIGN PATENT DOCUMENTS

| | | | | |
|---|---|---|---|---|
| EP | 0 616 354 A2 | | 9/1994 | |
| GB | 2 327 768 A2 | | 2/1999 | |
| JP | 03064736 A | * | 3/1991 | G02F/1/1339 |
| JP | 2001130009 A | * | 5/2001 | B41J/2/16 |
| WO | WO 98/40901 | | 9/1998 | |

* cited by examiner

*Primary Examiner*—Kenneth J. Ramsey
*Assistant Examiner*—Mariceli Santiago
(74) *Attorney, Agent, or Firm*—Burns Doane Swecker & Mathis, LLP

(57) ABSTRACT

A forming method of spacers in a flat panel display is provided. The method includes the steps of preparing a plurality of spacers in a predetermined shape, preparing a substrate on which the spacers are to be attached in the flat panel display, applying a photosensitive adhesive material on an upper surface of the substrate to a predetermined thickness, aligning the spacers on the substrate to attach the spacers by using the photosensitive adhesive material, radiating light onto the substrate from above the substrate to expose portions of the photosensitive adhesive material without the spacers, and removing the exposed portions of the photosensitive adhesive material. Therefore, the spacers are fixed on the substrate by the photosensitive adhesive material located under the spacers. According to the provided method of forming spacers, the spacers are fixed on the substrate by a mounting process using a jig, a temporary exposing process, and a developing process. In this case, the spacers are simultaneously placed on the substrate by the jig so that the spacers can be precisely aligned. The characteristic of the provided method of forming spacers is very effective in mass production of flat panel displays.

18 Claims, 8 Drawing Sheets

METHOD OF FORMING SPACER IN FLAT PANEL DISPLAY

Priority is claimed to Patent Application Number 2001-32950 filed in Republic of Korea on Jun. 12, 2001, herein incorporated by reference.

BACKGROUND OF THE INVENTION

1. Field of the Invention

The present invention relates to method of forming spacers in a flat panel display, and more particularly, to a method of forming spacers in a flat panel display requiring an inner vacuum such as a field emission display (FED).

2. Description of the Related Art

A flat panel display such as an FED having operating characteristics like electron emission in a vacuum space and luminescence due to excitation by the emitted electrons, includes a front plate, a rear plate, and spacers therebetween.

The flat panel display having an internal vacuum space requires a component for protecting the vacuum space and a structure for supporting the vacuum space from atmospheric pressure. The spacers are located between the front plate and the rear plate for maintaining a constant gap between the front and rear plates against the atmospheric pressure applied from outside.

In the case of a conventional FED, anode electrodes and a fluorescent layer are formed on the front plate, and electron emitting sources such as micro-tips or carbon nanotubes (CNTs), and cathodes and gate electrodes for controlling electron emission, are stacked on the rear plate.

Consequently, if the front or rear plate is deformed by the atmospheric pressure and other external pressure, the components on the front and rear plates are damaged. Especially, if the gap between the front and rear plates is changed, the emission and control of electrons will likely be severely disturbed.

Therefore, the gap between the front and rear plates has to be maintained firmly and stably in a flat panel display such as an FED. Moreover, the spacers between the front and rear plates have to be located at precise locations that do not trouble image display so as not to affect a displayed image.

For these reasons, in conventional methods of manufacturing a flat panel display, the spacers are individually formed or are stacked in a print manner. In the method of individually forming the spacers, an adhesive is applied to the spacers and the spacers are aligned and fixed onto a target at predetermined locations, for example an inner surface of the rear plate. The method includes a process of applying the adhesive, a process of aligning the spacers, and a process of loading the spacers, and thus takes a long time. Also, the rear plate is easily contaminated by an error in aligning the spacers resulting in spread of the adhesive applied to the spacers. Moreover, in the case of an FED, the precise alignment of the spacers between black matrixes of the anodes formed on an inner surface of the front plate requires expensive high-precision equipment.

Another problem is that adhesive is applied to the spacers and then the spacers are attached to the target. However, it is difficult to decide which adhesive to use for the processes and to form a pattern size of not greater than 50 $\mu$m, which is a minimum value for a printing mask.

Furthermore, a printing forming method of the spacers requires repetitive printing processes for achieving high-definition and has a limit in height with high aspect ratio.

SUMMARY OF THE INVENTION

To solve the above-described problems, it is an objective of the present invention to provide a method of forming spacers in a flat panel display which precisely aligns and fixes the spacers in the flat panel display and saves time and effort in forming the spacers by simplifying processes.

To accomplish the objective of the present invention, there is provided a method of forming spacers in a flat panel display comprising preparing a plurality of spacers in a predetermined shape, preparing a substrate on which the spacers are to be attached in the flat panel display, applying a photosensitive adhesive material on an upper surface of the substrate to a predetermined thickness, aligning the spacers on the substrate to attach the spacers by using the photosensitive adhesive material, radiating light onto the substrate from above the substrate to expose portions of the photosensitive adhesive material without the spacers, and removing the exposed portions of the photosensitive adhesive material, wherein the spacers are fixed on the substrate by the photosensitive adhesive material located under the spacers.

In an embodiment of the present invention, a process of soft baking the photosensitive adhesive material by using a thermal source may be further included before radiating light onto the substrate.

Also, a drying process for drying the substrate and an annealing process for annealing the adhesive material under the spacers by which the spacers are preferably attached to the substrate are further included before removing the exposed portions of the adhesive material.

A method of forming spacers in a flat panel display according to an embodiment of the present invention will be described in detail below with reference to the accompanying drawings. In the described embodiment of the present invention, the flat panel display is a field emission display (FED) that requires an inner vacuum space and spacers between front and rear plates.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

The principle structure of a field emission display (FED), such as a flat panel display, in which spacers are formed according to the present invention will be described.

Figure 1:
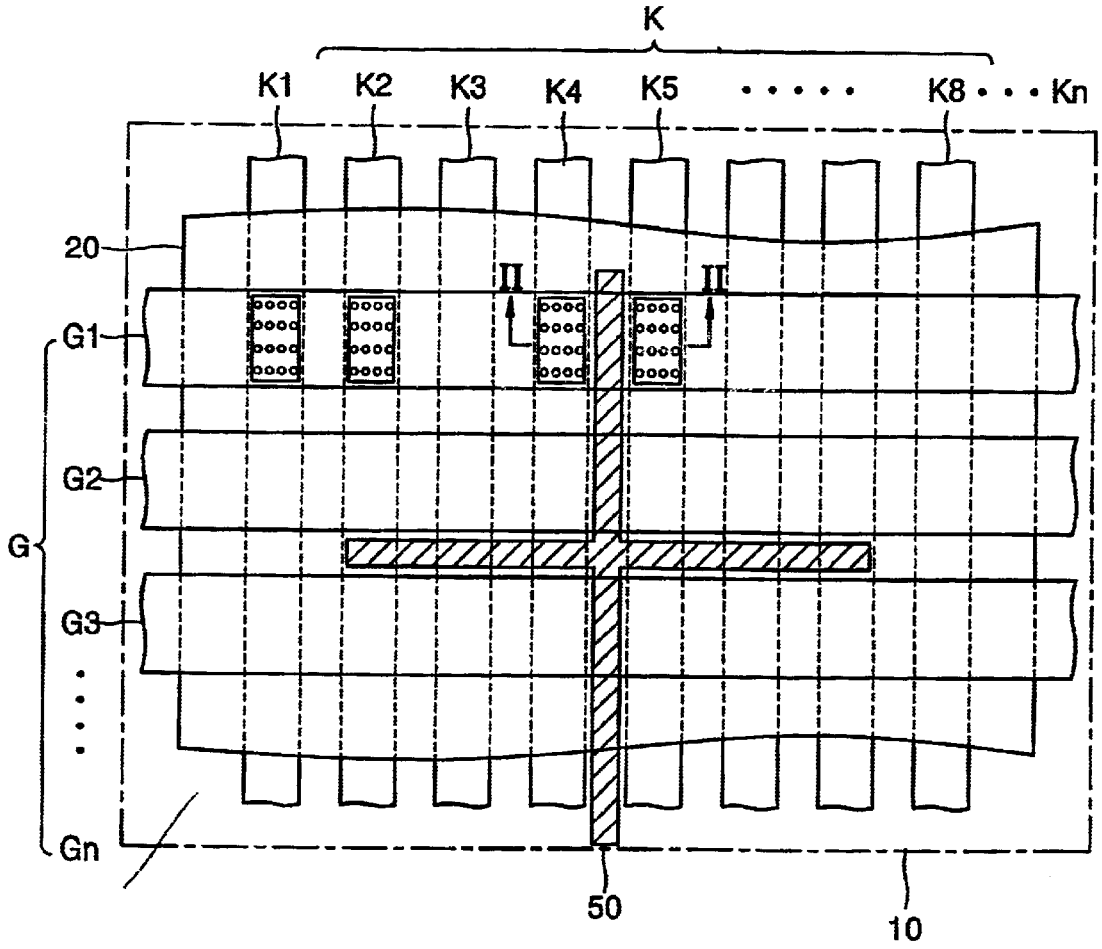
FIG. 1 is a partial plan view of a field emission display (FED) in which spacers are fixed according to the present invention.
Figure 2:
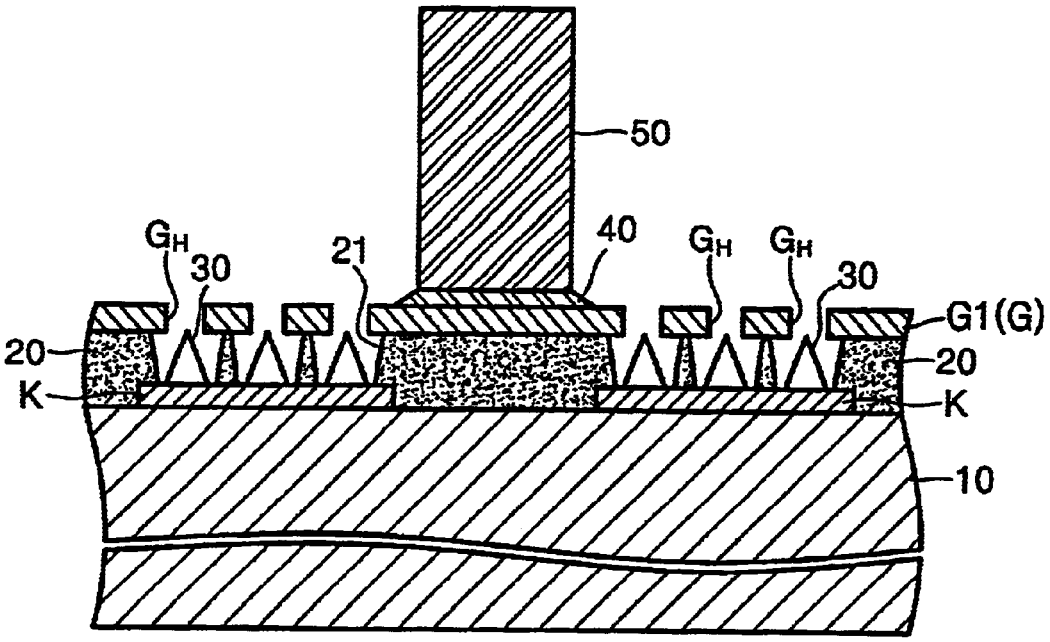
FIG. 2 is a sectional view cut along line II—II of FIG. 1.
Figure 3:
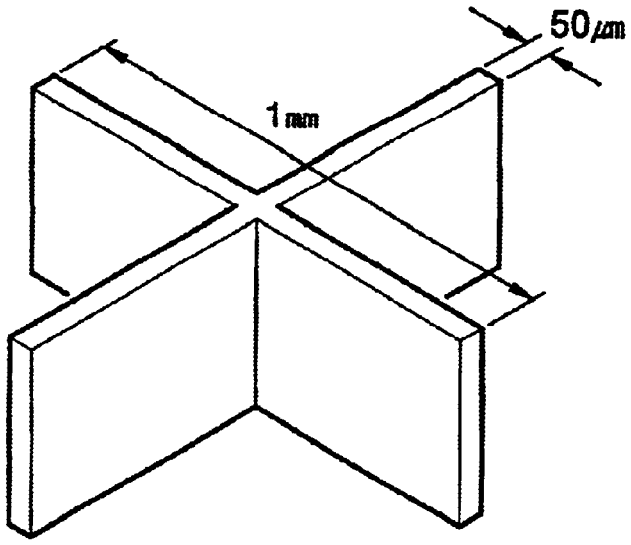
FIG. 3 is a schematic perspective view of a spacer according to the present invention.

FIG. 1 is a partial plan view of a rear plate (substrate) 10 of an FED having electron emission sources. FIG. 2 is a sectional view cut along line II—II of FIG. 1.

Referring to FIGS. 1 and 2, a plurality of cathode electrodes $K_1$, $K_2$, $K_3$, . . . $K_n$, and K is arranged in a first direction, namely, a longitudinal direction in FIG. 1, on the substrate 10 with a predetermined gap therebetween. A gate insulating layer 20 is formed on the cathode electrodes K for arranging a plurality of gate electrodes $G_1$, $G_2$, $G_3$, . . . , $G_n$, and G on the gate insulating layer 20 in a second direction, namely, a traverse direction in FIG. 1 that is perpendicular to the first direction. On the gate insulating layer 20, through holes 21 are formed for providing hollow portions in which micro-tips 30 are located on the cathode electrodes. A plurality of gate holes $G_H$ through which electrons penetrate is densely formed on the gate electrodes G at portions where the gate and cathode electrodes G and K cross. The gate holes $G_H$ are formed to correspond to the through holes 21 of the gate insulating layer 20. According to the structure described above, an electron emission structure with a plurality of micro-tips is arranged in one pixel, which is a portion where the gate and cathode electrodes G and K cross. On the structure, cross shape spacers 50 are fixed. The spacers 50 are arranged in gap portions between the gate and cathode electrodes G and K, namely, non-pixel regions from which electrons are not emitted. The spacers 50 are fixed on upper surfaces of the gate electrodes G and the gate insulating layer 20 by an adhesive layer 40. FIG. 2 illustrates the spacer 50 fixed on the gate electrode G by the adhesive layer 40. The adhesive layer 40 is formed of a photoresist such as polyimide.

The thickness of the spacers 50 is about 50 $\mu$m, which is the same as or smaller than the gaps between the gate electrodes G and between the cathode electrodes K. The length of the spacers 50 in one direction is about 1 mm. The spacers 50 are formed of a general soda lime glass.

A method of forming spacers in a flat panel display according to the present invention will now be described with reference to FIGS. 4 through 11.

The substrate 10 having the cathode electrodes K, the gate electrodes G, and the gate insulating layer 20 for emitting electrons as shown in FIGS. 1 and 2 is prepared. A plurality of spacers 50 is prepared for being arranged on one substrate 10. The elements formed on the substrate 10, such as the cathode electrodes, are omitted in FIGS. 4 through 11 for convenience.

Figure 4:
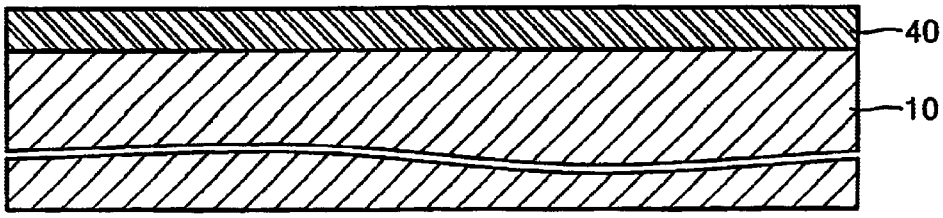
FIGS. 4 through 11 illustrate processes of forming spacers according to an embodiment of the present invention.

Referring to FIG. 4, a positive photoresist like polyimide is spread to a predetermined thickness, for example, 3 $\mu$m, on the substrate 10 having the cathode electrodes K, the gate electrodes G, and the gate insulating layer 20 so that the adhesive layer 40 is formed. It is preferable that the adhesive layer 40 is formed by a general spin coating method. After the adhesive layer 40 is formed on the substrate 10, the adhesive layer 40 physically and chemically protects the components on the substrate 10 in following processes of forming the spacer. Accordingly, the micro-tips and the gate electrodes are protected from external impact.

Figure 5:
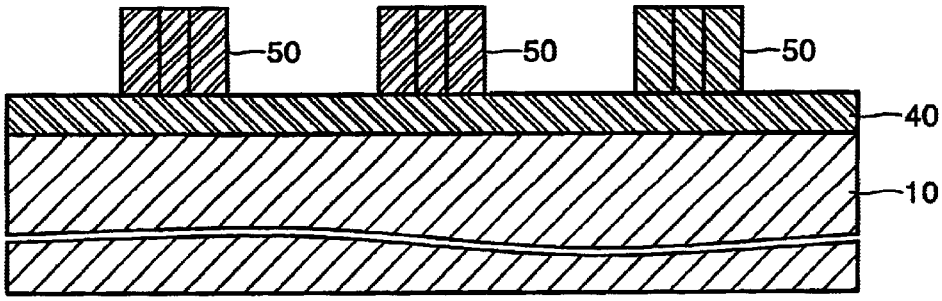

Referring to FIG. 5, a plurality of spacers 50 is arranged on the adhesive layer 40. In this case, the spacers 50 are located at regions where they do not interfere with electron emission. A jig is used for simultaneously placing a plurality of spacers 50 on the substrate 10.

Figure 6:
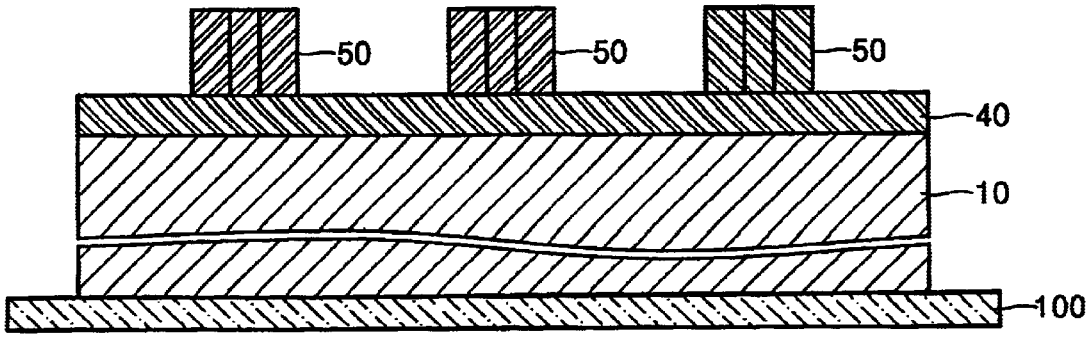

Referring to FIG. 6, the substrate 10 is placed on a heating unit such as a hot plate 100 for soft baking the adhesive layer 40.

Figure 7:
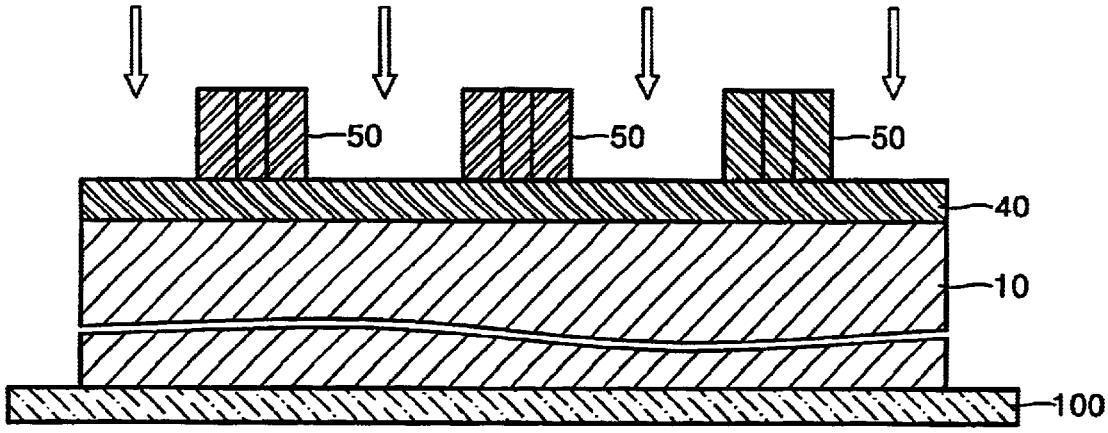

Referring to FIG. 7, ultraviolet rays are radiated from above the substrate 10 for exposing the adhesive layer 40. Accordingly, portions of the adhesive layer 40 on which the spacers 50 are not located are exposed.

Figure 8:
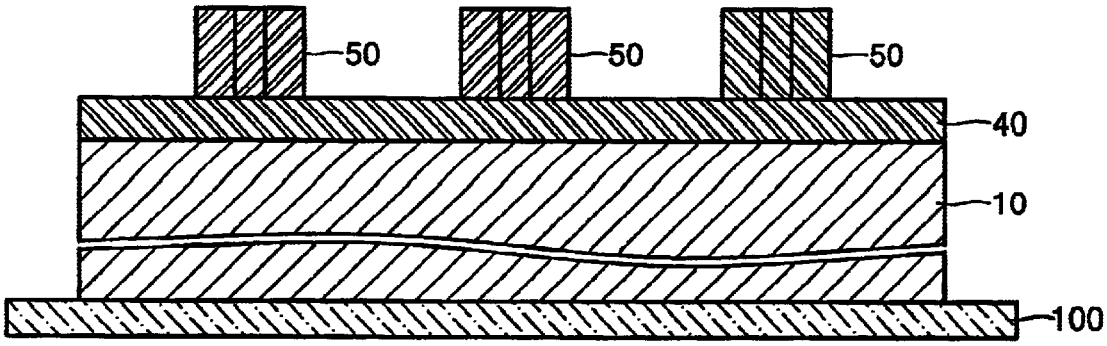

Referring to FIG. 8, the substrate 10 is placed on the hot plate 100 for performing a post exposure bake. As a result, the polyimide which forms the adhesive layer 40 is hardened, and the spacers 50 are firmly fixed on the substrate 10 by the adhesive layer 40.

Figure 9:
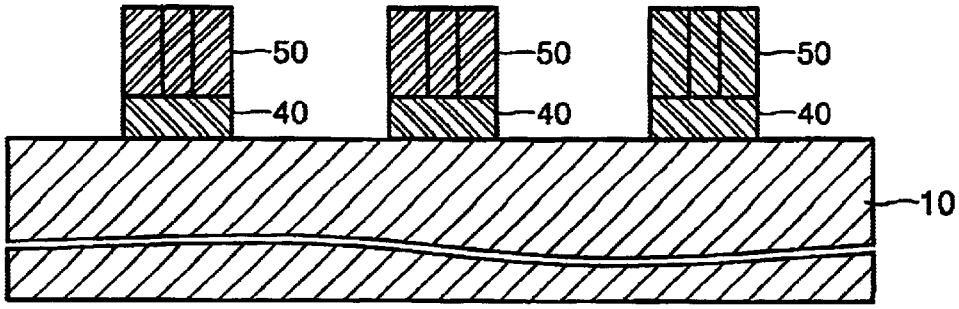

Referring to FIG. 9, the adhesive layer 40 is developed for removing the exposed portions. This process is a kind of developing process performed in general photolithography by using an etchant such as a solution for dissolving the exposed portions of the adhesive layer 40. After the developing process, cleaning and rinsing processes are performed for removing contaminants such as remaining organic material.

Figure 10:
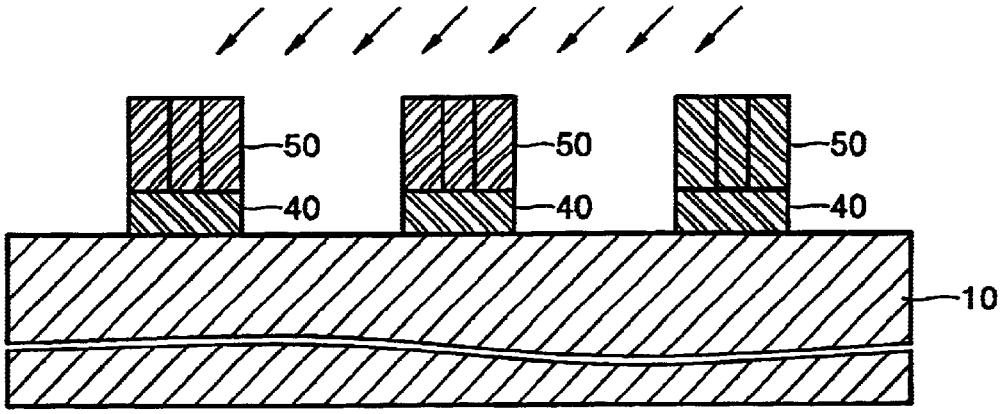

Referring to FIG. 10, air is blown onto the substrate 10 at an oblique angle. Accordingly, the cathode electrodes K, the gate electrodes G, the gate insulating layer 20, and the spacers 50 fixed on the gate insulating layer 20 by the adhesive layer 40 are dried.

Figure 11:
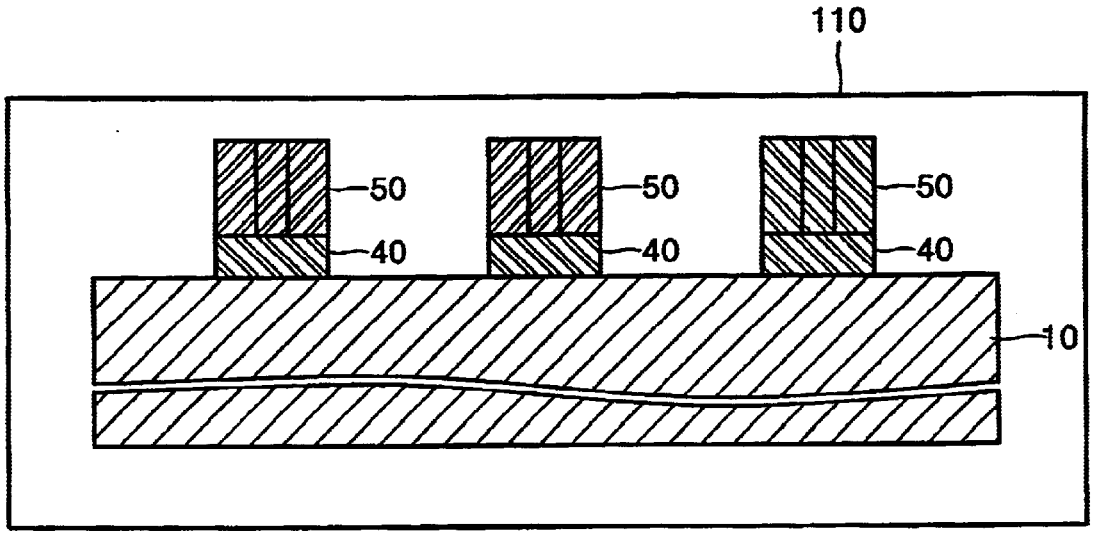

Referring to FIG. 11, the substrate 10 is heated in a vacuum chamber 110 at a temperature of about 350° C. thereby performing a vacuum annealing process. As a result, the substrate of the flat panel display having the spacers is obtained.

A portion of the FED substrate having the spacers formed by the above-described method is measured by scanning electron microscope (SEM) for examining the actual resulting FED substrate.

Figure 12:
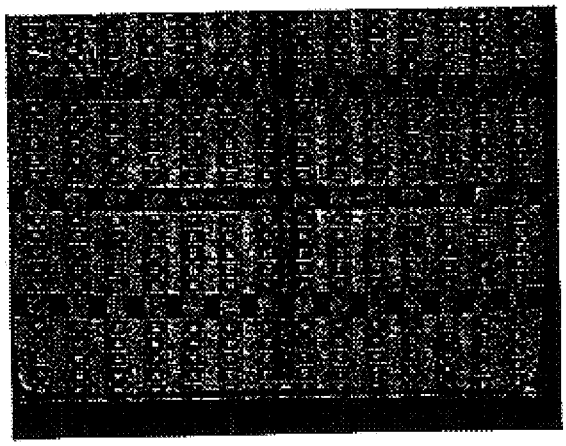
FIG. 12 is a scanning electron microscope (SEM) photograph of a portion of an FED on which a spacer is mounted according to the present invention.

FIG. 12 is a planar SEM photograph of a portion of the substrate having a spacer. In FIG. 12, the cross shape spacer is not prominent because the spacer is formed of a transparent material through which a lower pattern is seen. When the photograph is examined very carefully, a slightly darkened cross-shaped portion reveals the spacer.

Figure 13:
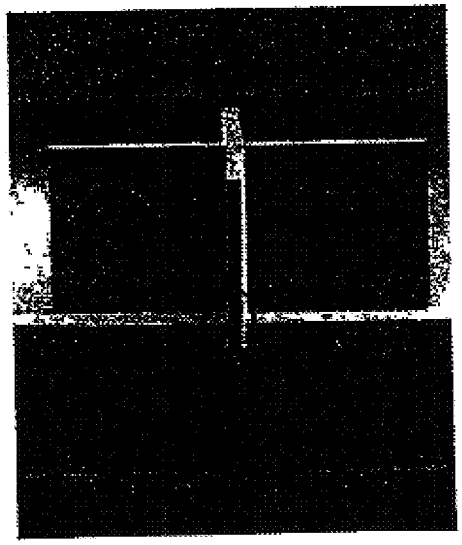
FIG. 13 is an SEM photograph illustrating an enlarged view of a spacer portion of an FED having spacers according to the present invention.
Figure 14:
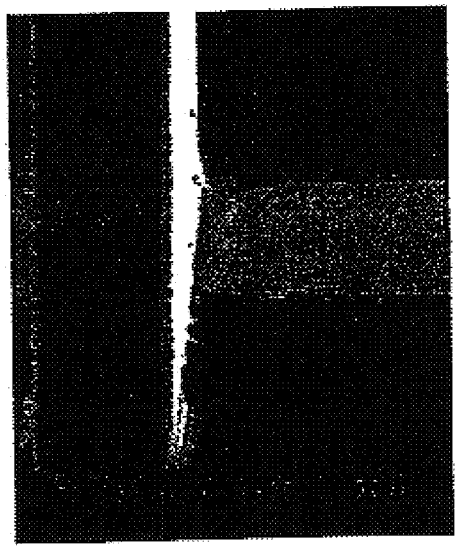
FIG. 14 is an enlargement of a portion of FIG. 13 encircled by a dotted line.

FIG. 13 is an SEM photograph illustrating an enlarged view of a spacer formed on a substrate according to the present invention, and FIG. 14 is an enlarged view of the portion of FIG. 13 encircled by a dotted line. As shown in FIGS. 13 and 14, the adhesive layer is spread around the base of the spacer.

Figure 15:
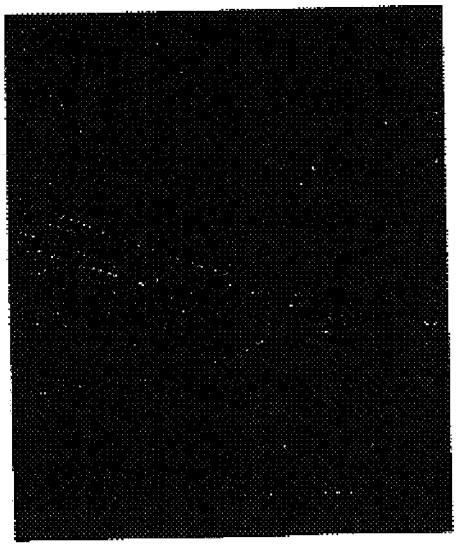
FIG. 15 is an SEM photograph illustrating an enlarged view of a portion on which a spacer has been fixed according to the present invention and forcibly separated to examine the thickness of an adhesive layer for fixing the spacer.
Figure 16:
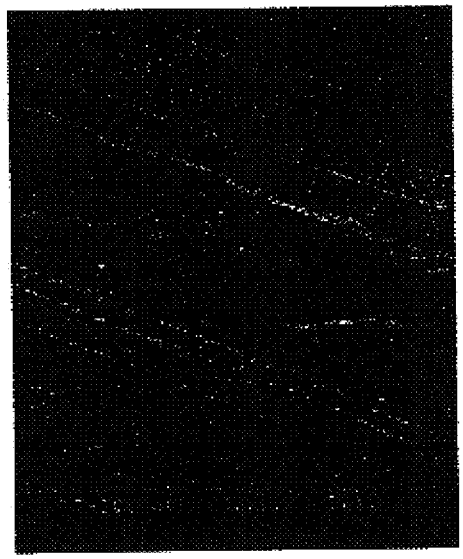
FIG. 16 is an enlargement of a portion of FIG. 15 encircled by a dotted line.
Figure 17:
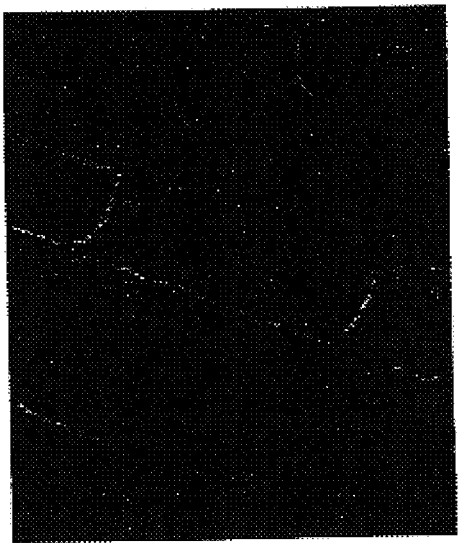
FIG. 17 is an enlargement of a portion of FIG. 16 encircled by a dotted line.

FIGS. 15 through 17 illustrate a portion in which the spacer has been fixed and after forcibly separated to examine the thickness of the adhesive layer. FIG. 15 is an SEM photograph of the portion in which the spacer has been fixed, FIG. 16 is an enlargement of a portion encircled by dotted lines in FIG. 15, and FIG. 17 is an enlargement a portion encircled by dotted lines in FIG. 16.

As shown in FIGS. 15 through 17, the adhesive layer has fixed the spacer with a uniform thickness. Especially, an uneven section at a connecting portion of the adhesive layer in FIG. 17 indicates that the spacer has been firmly fixed by the adhesive layer.

As described above, the spacers are formed on the substrate of a flat panel display by a photolithography method for firmly fixing the spacers on the substrate. Moreover, the adhesive layer is formed at portions for fixing the spacers and does not remain on other portions. Accordingly, in forming the adhesive layer for fixing the spacers, the spacers for maintaining a gap between the front and rear plates in the flat panel display are used as a mask in the photolithography process, thereby causing the adhesive layer to remain at predetermined portions. In addition, the spread state of the adhesive layer on the entire surface of the substrate is maintained until the developing process, thereby protecting the elements of the flat panel display such as the micro-tips and the gate electrodes.

According to the present invention, spacers are fixed on a substrate by a mounting process using a jig, a temporary exposing process, and a developing process. In this case, the spacers are simultaneously placed on the substrate by the jig so that the spacers can be precisely aligned. The characteristic of the present invention is very effective in mass production of flat panel displays.

According to the present invention, a photoresist like polyimide is used as an adhesive so that main elements formed on the substrate are physically and chemically protected in spacer forming processes. As a result, the elements of the flat panel display such as micro-tips and gate electrodes are protected from external impact.

While this invention has been particularly shown and described with reference to an FED, it will be understood by those skilled in the art that various changes in form and details may be made therein without departing from the spirit and scope of the invention as defined by the appended claims. For example, a method of forming spacers according to the present invention can be applied to any flat panel display requiring spacers, especially a flat panel display requiring very precise alignment and firm fixing force. Accordingly, the flat panel display defined in the appended claims is not limited to an FED, and the method of forming spacers in any kind of flat panel display is within the spirit and scope of the invention so far as the technical characteristics of the prevent invention as defined by the appended claims are used.

What is claimed is:

1. A method of forming spacers in a flat panel display comprising:

preparing a plurality of spacers in a predetermined shape;

preparing a substrate on which the spacers are to be attached in the flat panel display;

applying a photosensitive adhesive material on an upper surface of the substrate to a predetermined thickness;

aligning the spacers on the substrate to attach the spacers by using the photosensitive adhesive material;

radiating light onto the substrate from above the substrate to expose portions of the photosensitive adhesive material without the spacers; and removing the exposed portions of the photosensitive adhesive material, wherein the spacers are fixed on the substrate by the photosensitive adhesive material located under the spacers.

2. The method of forming spacers in a flat panel display of claim 1, wherein a process of soft baking the photosensitive adhesive material by using a thermal source is further included before radiating light onto the substrate.

3. The method of forming spacers in a flat panel display of claim 1, wherein a drying process for drying the substrate and an annealing process for annealing the adhesive material under the spacers by which the spacers are attached to the substrate are further included before removing the exposed portions of the adhesive material.

4. The method of forming spacers in a flat panel display of claim 2, wherein a drying process for drying the substrate and an annealing process for annealing the adhesive material under the spacers by which the spacers are attached to the substrate are further included before removing the exposed portions of the adhesive material.

5. The method of forming spacers in a flat panel display of claim 1, wherein the spacers are formed in a cross shape.

6. The method of forming spacers in a flat panel display of claim 2, wherein the spacers are formed in a cross shape.

7. The method of forming spacers in a flat panel display of claim 3, wherein the spacers are formed in a cross shape.

8. The method of forming spacers in a flat panel display of claim 4, wherein the spacers are formed in a cross shape.

9. The method of forming spacers in a flat panel display of claim 1, wherein the adhesive layer is formed of polyimide.

10. The method of forming spacers in a flat panel display of claim 2, wherein the adhesive layer is formed of polyimide.

11. The method of forming spacers in a flat panel display of claim 7, wherein the adhesive layer is formed of polyimide.

12. The method of forming spacers in a flat panel display of claim 8, wherein the adhesive layer is formed of polyimide.

13. The method of forming spacers in a flat panel display of claim 1, wherein the substrate is a rear plate of a field emission display (FED) including a field emission structure.

14. The method of forming spacers in a flat panel display of claim 2, wherein the substrate is a rear plate of a field emission display (FED) including a field emission structure.

15. The method of forming spacers in a flat panel display of claim 7, wherein the substrate is a rear plate of a field emission display (FED) including a field emission structure.

16. The method of forming spacers in a flat panel display of claim 8, wherein the substrate is a rear plate of a field emission display (FED) including a field emission structure.

17. The method of forming spacers in a flat panel display of claim 3, wherein the substrate is a rear plate of an FED including a field emission structure.

18. The method of forming spacers in a flat panel display of claim 4, wherein the substrate is a rear plate of an FED including a field emission structure.

* * * * *